US009747857B2

(12) United States Patent
Andou et al.

(10) Patent No.: US 9,747,857 B2
(45) **Date of Patent: *Aug. 29, 2017**

(54) DISPLAY DEVICE, METHOD OF DRIVING THE SAME, AND ELECTRONIC UNIT

(71) Applicant: Sony Corporation, Tokyo (JP)

(72) Inventors: Naoki Andou, Kanagawa (JP); Kouzi Tsukamoto, Fukuoka (JP); Takamitsu Urakawa, Fukuoka (JP); Kazuhiro Takeda, Fukuoka (JP); Keiko Kawaguchi, Fukuoka (JP); Taizou Hoshihara, Fukuoka (JP); Kouichi Hashikaki, Fukuoka (JP)

(73) Assignee: Sony Corporation, Tokyo (JP)

( * ) Notice: Subject to any disclaimer, the term of this patent is extended or adjusted under 35 U.S.C. 154(b) by 48 days.

This patent is subject to a terminal disclaimer.

(21) Appl. No.: 14/695,513

(22) Filed: Apr. 24, 2015

(65) Prior Publication Data

US 2015/0235604 A1 Aug. 20, 2015

Related U.S. Application Data

(63) Continuation of application No. 13/612,045, filed on Sep. 12, 2012, now Pat. No. 9,024,922.

(30) Foreign Application Priority Data

Sep. 22, 2011 (JP) ..... 2011-207986

(51) Int. Cl.
*G09G 5/00* (2006.01)
*G09G 3/36* (2006.01)
*G09G 5/18* (2006.01)

(52) U.S. Cl.
CPC ..... *G09G 3/3685* (2013.01); *G09G 5/18* (2013.01); *G09G 2300/0404* (2013.01)

(58) Field of Classification Search
CPC ..... G09G 3/3648; G09G 3/03688; G09G 3/3685; G09G 2310/0248; G09G 2320/0247; G09G 2330/025
See application file for complete search history.

(56) References Cited

U.S. PATENT DOCUMENTS 7,215,311 B2 * 5/2007 Kim ..... G09G 3/3648 345/100
9,024,922 B2 * 5/2015 Andou ..... G09G 3/3648 345/204

(Continued)

FOREIGN PATENT DOCUMENTS

JP 09-243998 9/1997
JP 10-115839 5/1998

(Continued)

OTHER PUBLICATIONS

Japanese Office Action issued Aug. 11, 2015 in corresponding Japanese Application No. 2011-207986.

(Continued)

*Primary Examiner* — Lixi C Simpson
(74) *Attorney, Agent, or Firm* — K&L Gates LLP

(57) ABSTRACT

A display device includes: data-line pairs arranged side by side along a first direction; gate lines arranged side by side along a second direction; a display section including pixels each disposed at an intersection of a data-line pair and a gate line and connected to one or both of the data-line pair; a data-line drive circuit supplying a positive-phase data signal to one of the data-line pair and a negative-phase data signal to the other, and allowing the data-line pair to stay in a high-impedance state before writing of an image signal to the pixels; and a short circuit putting the data-line pair in a short-circuit state while the data-line pair stays in the high-impedance state, and then releasing the short-circuit state Following the release of the short-circuit state, the (Continued)

positive-phase data signal or/and the negative-phase data signal are written into the pixel as the image signal.

16 Claims, 12 Drawing Sheets

(56) References Cited

U.S. PATENT DOCUMENTS

| | | | | |
|---|---|---|---|---|
| 2002/0050972 | A1 | 5/2002 | Udo et al. | |
| 2007/0018923 | A1* | 1/2007 | Yokota | G09G 3/3688 345/89 |
| 2007/0132684 | A1 | 6/2007 | Baek et al. | |
| 2009/0153044 | A1 | 6/2009 | Yanagihara | |
| 2009/0167739 | A1* | 7/2009 | Tsubata | G09G 3/3659 345/208 |
| 2010/0073389 | A1* | 3/2010 | Yasuda | G09G 3/3648 345/565 |
| 2010/0074032 | A1 | 3/2010 | Childs et al. | |
| 2011/0043439 | A1 | 2/2011 | Sasaki | |
| 2011/0050553 | A1 | 3/2011 | Takada et al. | |

FOREIGN PATENT DOCUMENTS

| | | |
|---|---|---|
| JP | 10-133174 | 5/1998 |
| JP | 10-282940 | 10/1998 |
| JP | 11-030975 | 2/1999 |
| JP | 2001-033757 | 2/2001 |
| JP | 2001-134245 | 5/2001 |
| JP | 2002-149133 | 5/2002 |
| JP | 20002-140045 | 5/2002 |
| JP | 2005-275056 | 10/2005 |
| JP | 2006-343609 | 12/2006 |
| JP | 2007-156483 | 6/2007 |
| JP | 2007-334109 | 12/2007 |
| JP | 2010-256917 | 11/2010 |

OTHER PUBLICATIONS

Japanese Office Action issued Jun. 2, 2015 in corresponding Japanese Application No. 2011-207986.

* cited by examiner

DISPLAY DEVICE, METHOD OF DRIVING THE SAME, AND ELECTRONIC UNIT

CROSS REFERENCES TO RELATED APPLICATIONS

The present application is a continuation of U.S. patent application Ser. No. 13/612,045, filed Sep. 12, 2012, which application claims priority to Japanese Priority Patent Application No. JP2011-207986 filed in the Japan Patent Office on Sep. 22, 2011, the entire content of which is hereby incorporated by reference.

BACKGROUND

The present disclosure relates to a display device including a plurality of pixels arranged in a matrix and performing a digital drive based on, for example, a differential digital signal, and a method of driving the same, and an electronic unit including such a display device.

FIG. 12 illustrates a configuration example of a typical active matrix display device. The display device includes a data-line group and a gate-line group, and pixels 111 each are disposed at an intersection of a data line in the data-line group and a gate line in the gate-line group to configure a display region 110 (in a region indicated by a broken line). The data-line group is configured of a plurality of data lines D1 to Dn arranged side by side. The gate-line group is electrically insulated from the data-line group, and is configured of a plurality of gate lines G1 to Gm arranged side by side along a direction perpendicular to the data-line group. A data-line drive circuit 112 driving the data-line group and a gate-line drive circuit 113 driving the gate-line group are disposed around the display region 110. Japanese Unexamined Patent Application Publication Nos. H9-243998 and 2010-256917 disclose technology for such an active matrix display device.

SUMMARY

In active matrix display devices, variations in a power supply potential and a ground potential in a pixel section are one factor affecting image quality. The variations are caused by a voltage drop, as a main factor, according to a data-line charge-discharge current during writing to a pixel. A current during writing is not constantly fixed, and is determined by a relationship between a data-line potential before writing and a signal potential to be written at a next timing; therefore, variation amounts of the power supply potential and the ground potential vary depending on write data (gray scale). In particular, in a pulse width modulation (PWM) mode liquid crystal display device performing writing of a digital value to a pixel, H (high)-level data as the power supply potential and L (low)-level data as the ground potential are applied to the pixel; however, as display is performed by applying a voltage between a pixel electrode and a counter electrode to a liquid crystal, variations in the power supply potential directly lead to image quality degradation. Such image quality degradation is more pronounced by an increase in the number of data lines for higher resolution, i.e., an increase in data-line charge-discharge current, and it is necessary to take measures against such image quality degradation.

It is desirable to provide a display device capable of suppressing potential variations in data lines to perform display with less image quality degradation caused by the potential variations, a method of driving the same, and an electronic unit.

According to an embodiment of the disclosure, there is provided a display device including: a plurality of data-line pairs arranged side by side along a first direction; a plurality of gate lines arranged side by side along a second direction; a display section including a plurality of pixels each disposed at an intersection of a data-line pair and a gate line and connected to one or both of the data-line pair; a data-line drive circuit supplying a positive-phase data signal to one of the data-line pair and a negative-phase data signal to the other of the data-line pair, and allowing the data-line pair to stay in a high-impedance state before writing of an image signal to the pixels; and a short circuit putting the data-line pair in a short-circuit state while the data-line pair stays in the high-impedance state, and then releasing the short-circuit state, in which, following the release of the short-circuit state, the positive-phase data signal, the negative-phase data signal or both thereof are written into the pixel as the image signal.

According to an embodiment of the disclosure, there is provided a method of driving a display device, the display device including a plurality of data-line pairs arranged side by side along a first direction, a plurality of gate lines arranged side by side along a second direction, a display section including a plurality of pixels each disposed at an intersection of a data-line pair and a gate line and connected to one or both of the data-line pair, a data-line drive circuit supplying a positive-phase data signal to one of the data-line pair and a negative-phase data signal to the other of the data-line pair, and allowing the data-line pair to stay in a high-impedance state before writing of an image signal to the pixels, and a short circuit putting the data-line pair in a short-circuit state while the data-line pair stays in the high-impedance state, and then releasing the short-circuit state, the method including, following the release of the short-circuit state, writing the positive-phase data signal, the negative-phase data signal or both thereof into the pixel as the image signal.

According to an embodiment of the disclosure, there is provided an electronic unit including a display device, the display device including: a plurality of data-line pairs arranged side by side along a first direction; a plurality of gate lines arranged side by side along a second direction; a display section including a plurality of pixels each disposed at an intersection of a data-line pair and a gate line and connected to one or both of the data-line pair; a data-line drive circuit supplying a positive-phase data signal to one of the data-line pair and a negative-phase data signal to the other of the data-line pair, and allowing the data-line pair to stay in a high-impedance state before writing of an image signal to the pixels; and a short circuit putting the data-line pair in a short-circuit state while the data-line pair stays in the high-impedance state, and then releasing the short-circuit state, in which, following the release of the short-circuit state, the positive-phase data signal, the negative-phase data signal or both thereof are written into the pixel as the mage signal.

In the display device, the method of driving the same, or the electronic unit according to the embodiment of the disclosure, the data-line pair is allowed to stay in the high-impedance state before writing of the image signal to the pixels. Moreover, the short circuit puts the data-line pair in the short-circuit state while the data-line pair stays in the high-impedance state, and then releases the short-circuit state. Then, the positive-phase data signal, the negative-phase data signal or both thereof are written into the pixel as the image signal.

In the display device, the method of driving the same, or the electronic unit according to the embodiment of the disclosure, the data-line pair is allowed to stay in the high-impedance state before writing of the image signal to the pixels, and the short circuit puts the data-line pair in the short-circuit state while the data-line pair stays in the high-impedance state, and then releases the short-circuit state. Then, the positive-phase data signal, the negative-phase data signal or both thereof are written into the pixel as the image signal. Therefore, potential variations in data lines are allowed to be suppressed, thereby performing display with less image quality degradation caused by the potential variations.

Additional features and advantages are described herein, and will be apparent from the following Detailed Description and the figures.

DETAILED DESCRIPTION

Embodiments of the present application will be described below in detail with reference to the drawings.

First Embodiment

[Configuration of Display Device]

Figure 1:
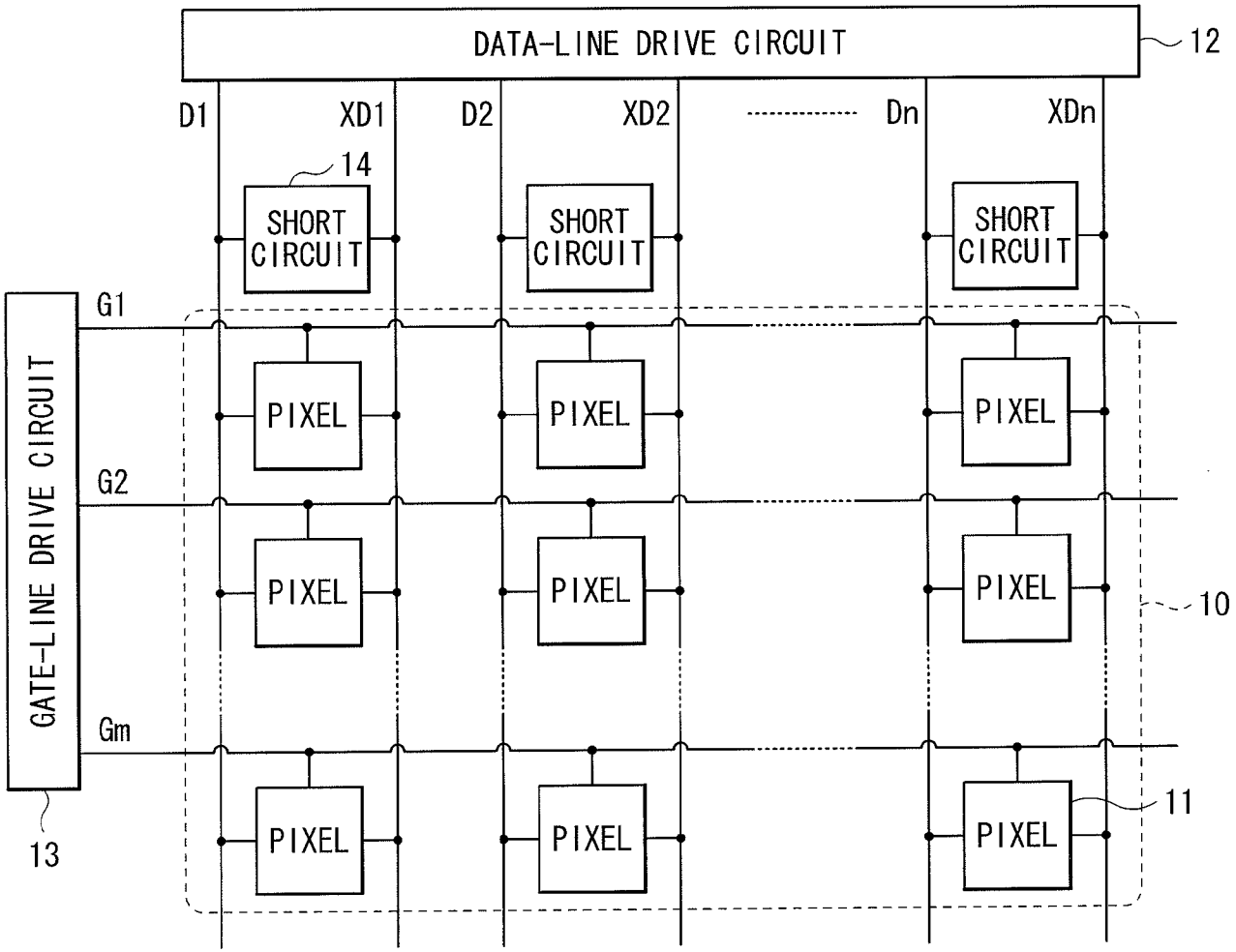
FIG. 1 is a block diagram illustrating a configuration example of a display device according to a first embodiment of the disclosure.

FIG. 1 illustrates a configuration example of a display device according to a first embodiment of the disclosure. The display device includes a data-line group and a gate-line group, and pixels 11 each are disposed at an intersection of a data line in the data-line group and a gate line in the gate-line group in a matrix to configure a display region (a display section) 10 (in a region indicated by a broken line).

The data-line group is configured of a plurality of data lines D1 to Dn and XD1 to XDn arranged side by side along a first direction (a horizontal direction). The plurality of data lines D1 to Dn and XD1 to XDn are in a differential configuration in which the data lines D1 to Dn are in positive phase and the data lines XD1 to XDn are in negative phase, and, for example, one data line Dn in positive phase and one data line XDn in negative phase configures a pair of data lines. Therefore, the data-line group is configured of a plurality of pairs of data lines arranged side by side along the horizontal direction. For example, one of the plurality of pairs of data lines is hereinafter referred to as a pair of data lines Dn/XDn. The gate-line group is electrically insulated from the data-line group. The gate-line group is configured of a plurality of gate lines G1 to Gm arranged side by side along a second direction (a vertical direction).

A data-line drive circuit 12 driving the data-line group and a gate-line drive circuit 13 driving the gate-line group are disposed around the display region 10. The data-line drive circuit 12 sequentially supplies, in the horizontal direction, image data signals (gray-scale signals) based on an image signal to the plurality of pixels 11 through the data-line group. More specifically, the data-line drive circuit 12 supplies a positive-phase data signal to one line (for example, Dn) of a pair of data lines (for example, Dn/XDn), and supplies a negative-phase data signal to the other line (for example, XDn) of the pair of data lines. The gate-line drive circuit 13 sequentially supplies, in the vertical direction, a gate signal (a scanning signal) to the plurality of pixels 11 through the gate-line group.

Each of the pixels 11 is disposed at an intersection of a pair of data lines (for example, Dn/XDn) and a gate line (for example, Gm). Each of the pixels 11 is connected to both of the pair of data lines (for example, Dn/XDn), and an image signal as a differential signal between the positive-phase data signal and the negative-phase data signal is written to the pixel 11. The display device is driven in, for example, a pulse width modulation (PWM) mode, and, for example, a digital value of 0 or 1 as the image signal is written to the pixel 11.

The display device includes a short circuit 14. The short circuit 14 is disposed between the display region 10 and the data-line drive circuit 12. The short circuit 14 is provided for each of the plurality of pairs of data lines, and allows the pair of data lines to be short-circuited. The short circuit 14 temporarily puts the pair of data lines in a short-circuit state before writing of the image signal to the pixel 11 to set a potential between the pair of data lines to an intermediate potential between a positive-phase potential and a negative-phase potential, and then, releases the short-circuit state, and then writing of the image signal to the pixel 11 is performed. The data-line drive circuit 12 allows the pair of data lines to stay in a high-impedance state before writing of the image signal to the pixel 11.

The plurality of pixels 11 have, for example, a configuration of a liquid crystal display panel. The liquid crystal display panel has a configuration in which a liquid crystal layer is sandwiched between a pixel substrate and a counter substrate, and the liquid crystal display panel allows light passing through the liquid crystal layer to be modulated by applying an electric field between the pixel substrate and the counter substrate.

(Specific Example of Drive Circuit for Each Pixel 11)

Figure 2:
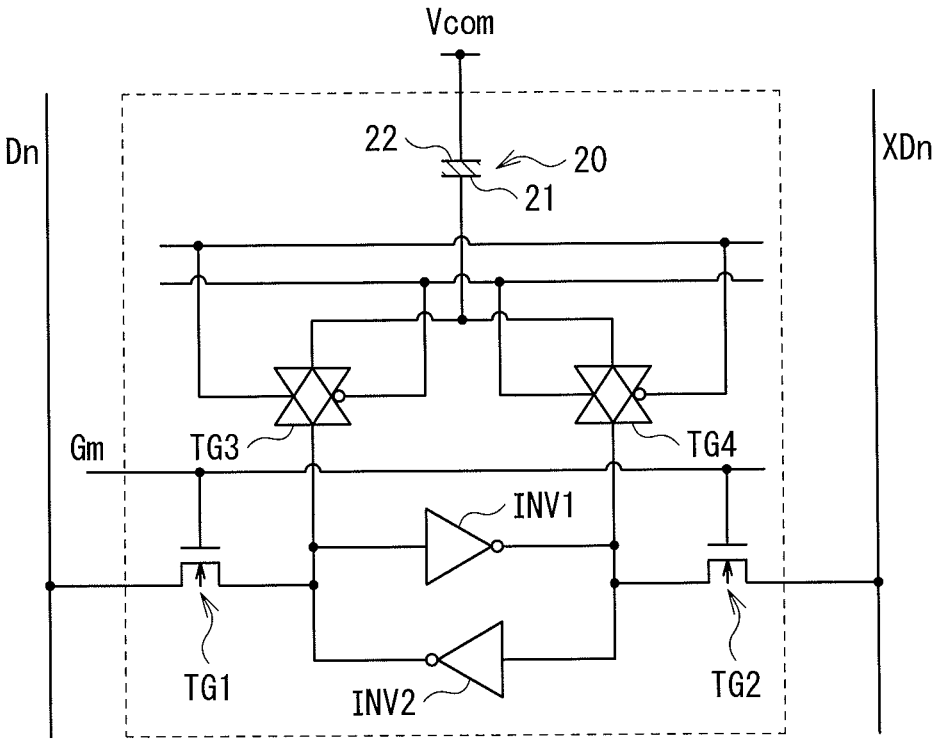
FIG. 2 is a circuit diagram illustrating a specific example of a drive circuit for each pixel in the display device according to the first embodiment.

FIG. 2 illustrates a specific example of a drive circuit for each pixel 11. The display device described here is a pulse width modulation mode liquid crystal display device performing writing of a digital value to the pixels 11. Moreover, in FIG. 2, the pixel 11 disposed at an intersection of the pair of data lines Dn/XDn and the gate line Gm is illustrated as a representative. The drive circuit includes pixel electrodes 21, a counter electrode 22, and a liquid crystal capacitor 20 formed between the pixel electrodes 21 and the counter electrode 22. The pixel electrodes 21 correspond to the plurality of pixels 11, respectively, and are arranged in a matrix on a pixel substrate (not illustrated). The counter electrode 22 is disposed on a counter substrate (not illustrated) as a common electrode for the plurality of pixels 11.

The drive circuit further includes a first transfer gate TG1, a second transfer gate TG2, a third transfer gate TG3, a fourth transfer gate TG4, a first inverter INV1, and a second inverter INV2.

The first transfer gate TG1 is connected to the gate line Gm and the data line Dn. The second transfer gate TG2 is connected to the gate line Gm and the data line XDn. The first inverter INV1 and the second inverter INV2 are disposed between the first transfer gate TG1 and the second transfer gate TG2. The third transfer gate TG3 and the fourth transfer gate TG4 are CMOS (Complementary Metal Oxide Semiconductor)-type circuits. A first terminal of the third transfer gate TG3 is connected between the first transfer gate TG1, and the first inverter INV1 and second inverter INV2. A first terminal of the fourth transfer gate TG4 is connected between the second transfer gate TG2, and the first inverter INV1 and the second inverter INV2. The pixel electrode 21 is connected to a second terminal of the third transfer gate TG3 and a second terminal of the fourth transfer gate TG4. A common potential (Vcom) is applied to the counter electrode 22.

[Operation of Display Device]

(Operation of Display Device According to Comparative Example)

First, as a comparative example, an operation and an issue of a display device not including the short circuit 14 (refer to FIG. 9) will be described below. The display device according to the comparative example has a similar configuration as the configuration illustrated in FIGS. 1 and 2, except that the short circuit 14 is not included.

Figure 9:
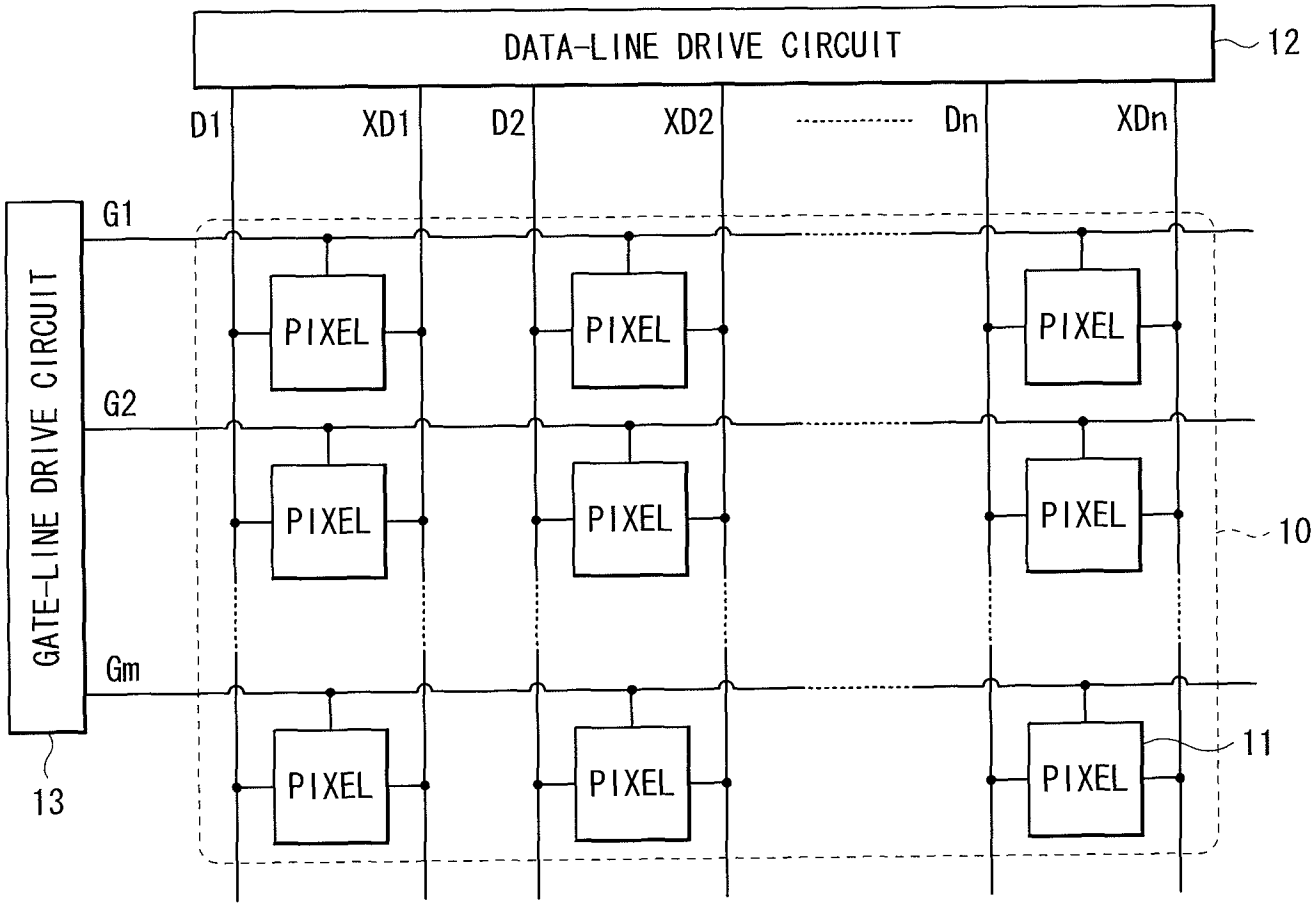
FIG. 9 RELATED ART
FIG. 9 is a block diagram illustrating a configuration example of a display device according to a comparative example.
Figure 10:
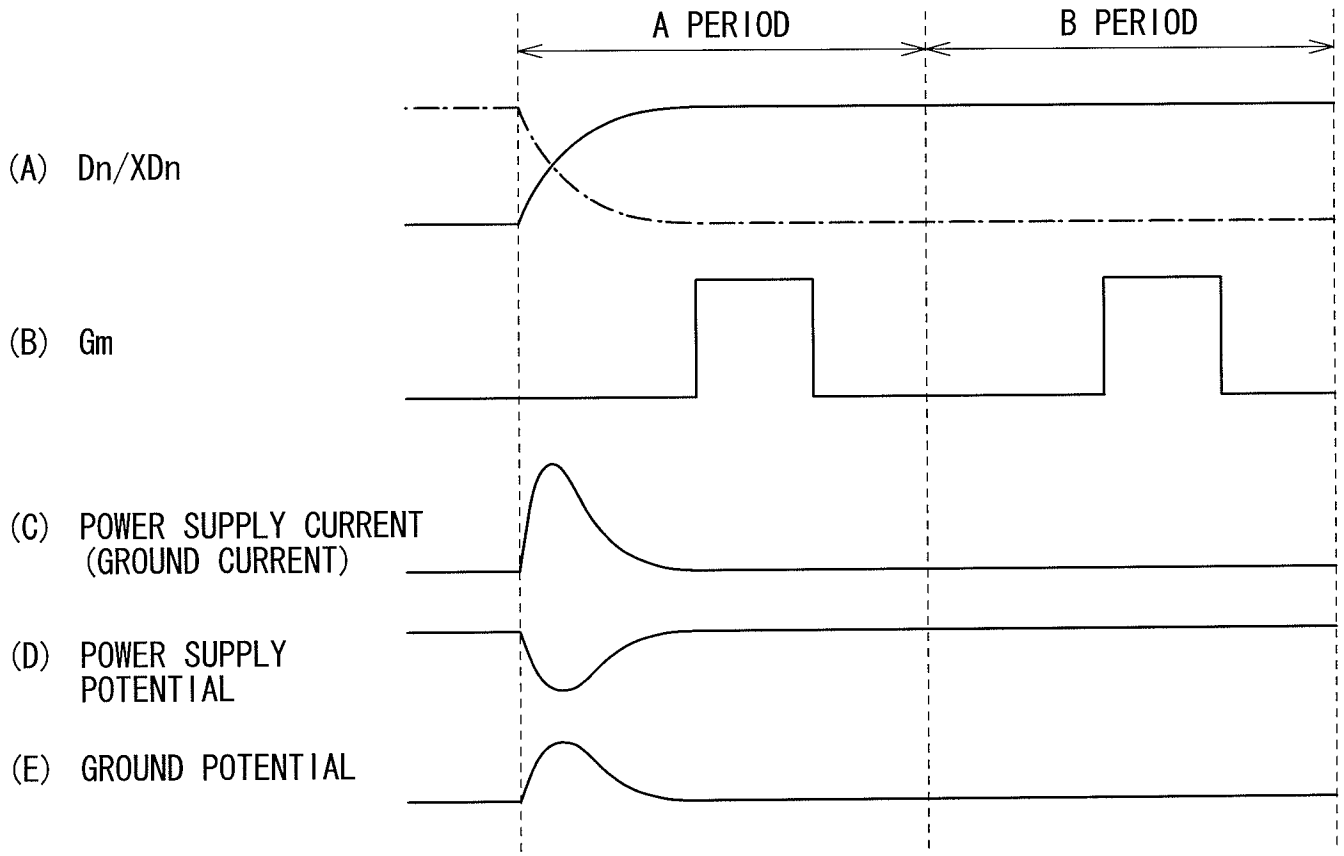
FIG. 10 RELATED ART
FIG. 10 is a waveform chart in the display device according to the comparative example, where parts (A), (B), (C), (D), and (E) illustrate waveforms of potentials of data lines, a potential of a gate line, a power supply current (a ground current), a power supply potential, and a ground potential, respectively.

Parts (A) to (E) in FIG. 10 illustrate waveform images during writing in the display device according to the comparative example illustrated in FIG. 9. It is to be noted that, in the parts (A) to (E) in FIG. 10, a case where a writing operation is performed on the pixel 11 disposed at the intersection of the pair of data lines Dn/XDn and the gate line Gm is illustrated as a representative. In an A period, potentials (refer to the part (A) in FIG. 10) of the pair of data lines Dn/XDn vary by switching of output data of the data-line drive circuit 12, and then data is written to the pixel 11 in an H (high)-level period (refer to the part (B) in FIG. 10) of the gate line Gm. At this time, as the power supply current and the ground current (refer to the part (C) in FIG. 10) for charge and discharge of the pair of data lines Dn/XDn flow, variations in the power supply potential and the ground potential caused by a voltage drop occur (refer to the parts (D) and (E) in FIG. 10). On the other hand, in a B period, the potentials of the pair of data lines Dn/XDn do not vary, and the power supply current and the ground current do not flow; therefore, variations in the potentials do not occur.

Figure 11:
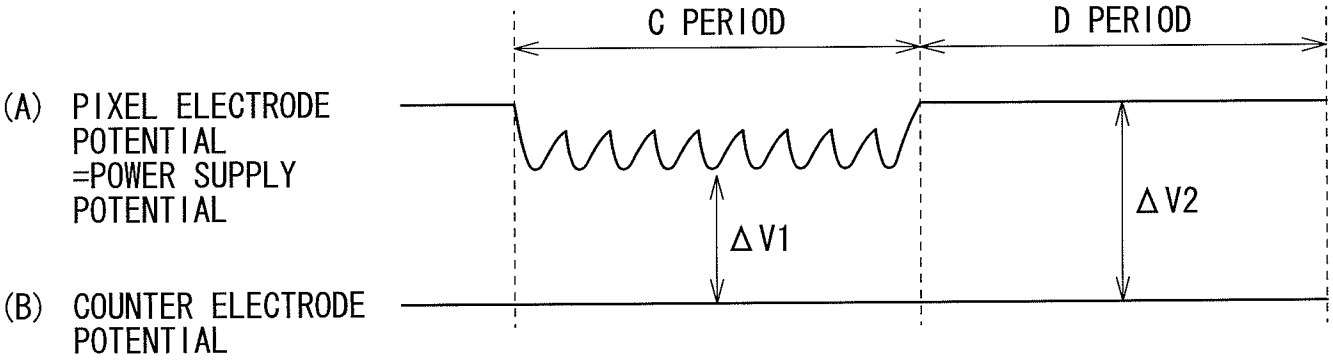
FIG. 11 RELATED ART
FIG. 11 is a waveform chart illustrating an example of variations in potentials in the display device according to the comparative example, where parts (A) and (B) illustrate waveforms of a pixel electrode potential and a counter electrode potential, respectively.
Figure 12:
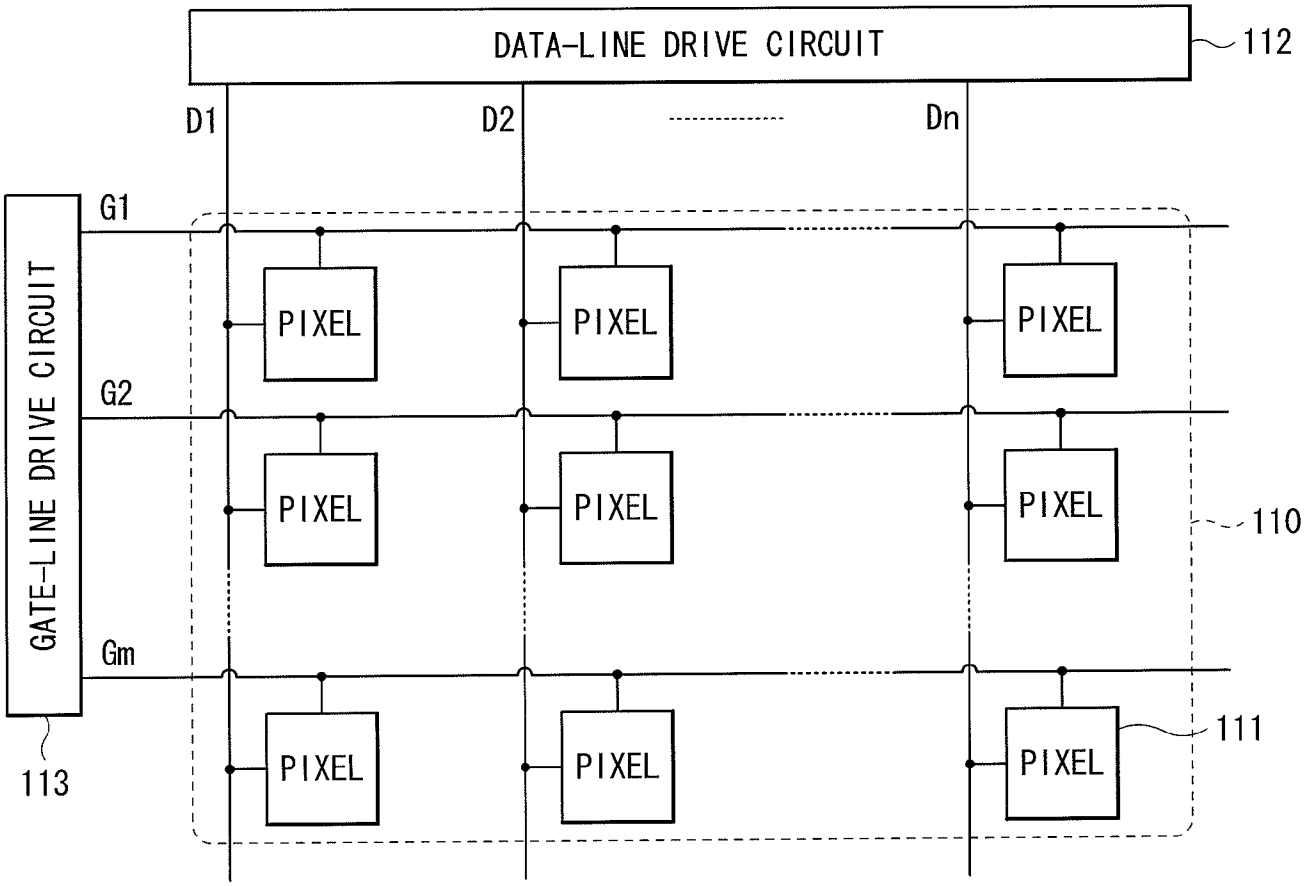
FIG. 12 RELATED ART
FIG. 12 is a block diagram illustrating a configuration example of a display device in related art.

Variations in the power supply potential and the ground potential differ according to the state of data in such a manner, and images of the potentials of the pixel electrode 21 and the counter electrode 22 in a longer period are illustrated in parts (A) and (B) in FIG. 11. A case where, in the pixel 11 holding H-level data, variations in the power supply potential caused by variations in data line potentials in other pixels occur in a C period, and variations in the data line potentials in other pixels do not occur, thereby not causing variations in the power supply potential in a D period is considered. At this time, a pixel electrode potential holding an H level is equal to the power supply potential; therefore, the level of the pixel electrode potential declines in the C period, but the pixel electrode potential does not decline in the D period. A counter electrode potential is not affected by a circuit operation and is fixed; therefore, ideally, a difference voltage between the pixel electrode potential and the counter electrode potential represented by V2 in the D period is supposed to be applied to a liquid crystal; however, in the C period, the difference voltage applied to the liquid crystal is reduced to V1, and an intended gray scale is not displayed accordingly, thereby causing an issue of image quality degradation. Moreover, even if external data input is corrected in consideration of variations in the power supply potential and the ground potential, variation amounts of the power supply potential and the ground potential vary according to data; therefore, it is difficult to perform correction in consideration of the variation amounts.

(Improved Operation Example)

An operation of the display device according to the embodiment obtained by improving the display device according to the above-described comparative example will be described below referring to FIGS. 3 and 4.

In the display device according to the embodiment, to reduce image quality degradation caused by variations in the power supply potential and the ground potential according to a charge-discharge current of the data-line group during writing of an image signal, the data-line group temporarily stays in a high-impedance state before writing of the image signal. Meanwhile, a positive-phase data line and a negative-phase data line forming a pair are short-circuited by the short circuit 14 to set the potential of the data-line group to an intermediate potential ((½) (H level+L level)) between the positive-phase potential and the negative-phase potential, and then writing is performed. Thus, the charge-discharge current of the data-line group when repeatedly performing writing of the image signal is made uniform to suppress variations in the power supply potential and the ground potential, thereby achieving an image quality improvement with less screen flickering. Screen flickering is caused by a decline in luminance or variations in luminance with time due to variations in a voltage applied to the liquid crystal.

Figure 3:
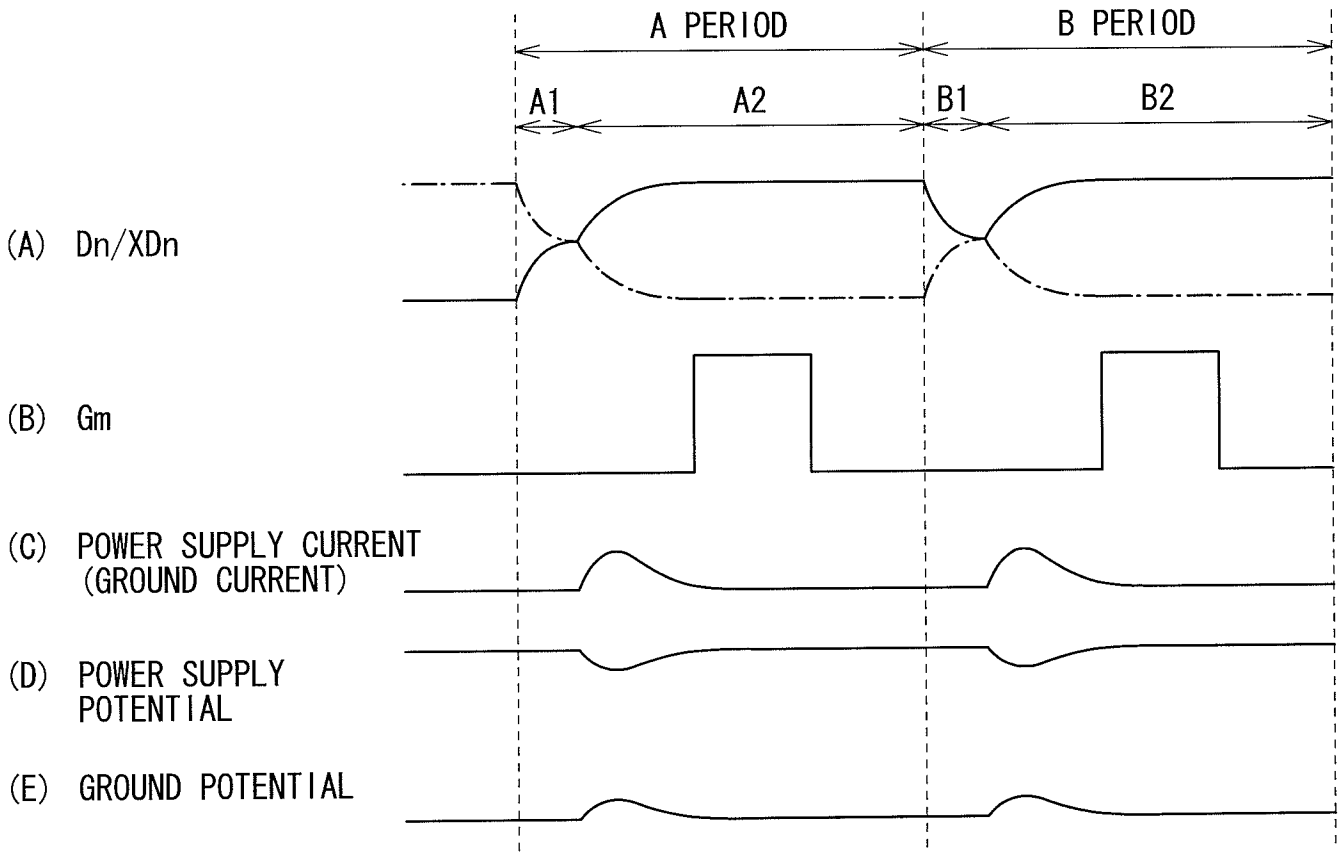
FIG. 3 is a waveform chart, where parts (A), (B), (C), (D), and (E) illustrate waveforms of potentials of a pair of data lines, a potential of a gate line, a power supply current (a ground current), a power supply potential, and a ground potential, respectively.

Parts (A) to (E) in FIG. 3 illustrate waveform images during the writing operation of the display device. As in the case of the above-described parts (A) to (E) in FIG. 10, the images under condition that the potentials of the pair of data lines Dn/XDn vary in the A period, and do not vary in the B period are illustrated in the parts (A) to (E) in FIG. 3. In the operation in this configuration, the data line Dn and the data line XDn forming a pair are put in a short-circuit state through the short circuit 14 in a A1 period of the A period and a B1 period of the B period to set the potentials of the pair of data lines Dn/XDn to the intermediate potential. As one of the potentials of the data line Dn and the data line XDn before being short-circuited is constantly at an H (high) level and the other one is constantly at a L (low) level, the intermediate potential after they are short-circuited is constantly equal to ((½) (H level+L level)). At this time, an output of the data-line drive circuit 12 concurrently stays in a high-impedance state to be prevented from being short-circuited. In a A2 period and a B2 period after the pair of data lines Dn/XDn has the intermediate potential, the short circuit 14 is disconnected to release the short-circuit state, and charge and discharge of the pair of data lines Dn/XDn are completed by a drive from the data-line drive circuit 12, and after that, the gate line Gm is set to the H level to perform writing of data to the pixel 11. By such a driving method, the potential of one of the pair of data lines Dn/XDn is switched from the intermediate potential to the level of the power supply potential and the potential of the other of the pair of data lines Dn/XDn is switched from the intermediate potential to the level of the ground potential, though switching directions of the potentials of the data lines Dn and XDn differ between the A period and the B period by the written data. Therefore, there is no difference in the power supply current and the ground current supporting charge and discharge of the pair of data lines Dn/XDn between the A period and the B period, and there is no difference in variations in the power supply potential and the ground potential between the A period and the B period.

Figure 4:
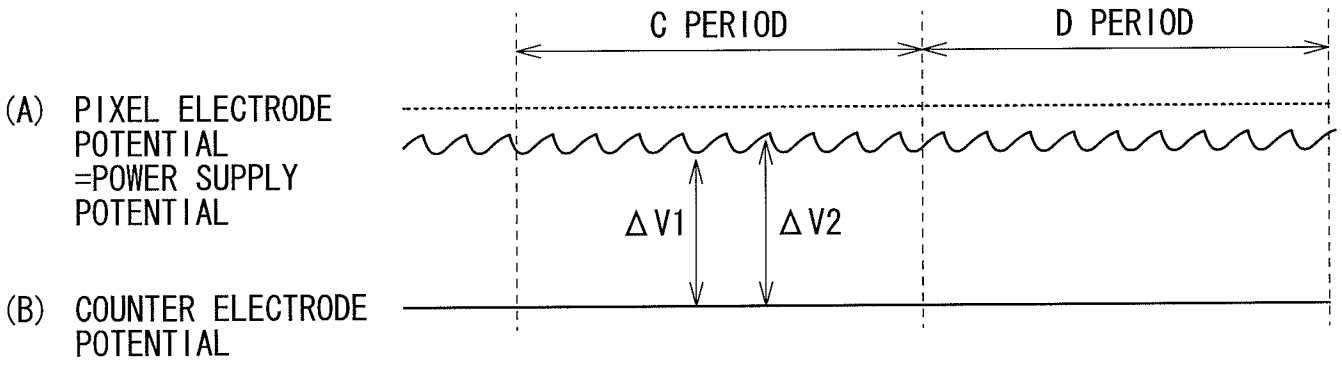
FIG. 4 is a waveform chart, where parts (A) and (B) illustrate waveforms of a pixel electrode potential and a counter electrode potential, respectively.

Parts (A) and (B) in FIG. 4 illustrate images of the potentials of the pixel electrode 21 and the counter electrode 22, respectively, in the pixel 11 holding H-level data in the case where variations in data line potentials in other pixels occur in the C period, and variations in the data line potentials in other pixels do not occur in the D period under condition similar to that in the parts (A) and (B) in FIG. 11. As there is no difference in variations in the power supply potential between the C period and the D period, there is no difference in the pixel electrode potential between the C period and the D period. Even in such a driving method, variations in the power supply potential transiently occurs as indicated by V1 and V2 illustrated in the parts (A) and (B) in FIG. 4, and the potentials are not perfectly uniform; however, an issue in the above-described comparative example, i.e., variations in the power supply potential and the ground potential depending on previous or subsequent write data are suppressed, and image quality degradation depending on write data is suppressed to improve image quality.

[Effects]

As described above, in the display device according to the embodiment, potential variations in the data lines are suppressed to perform display with less image quality degradation caused by the potential variations.

Modification of First Embodiment

Figure 5:
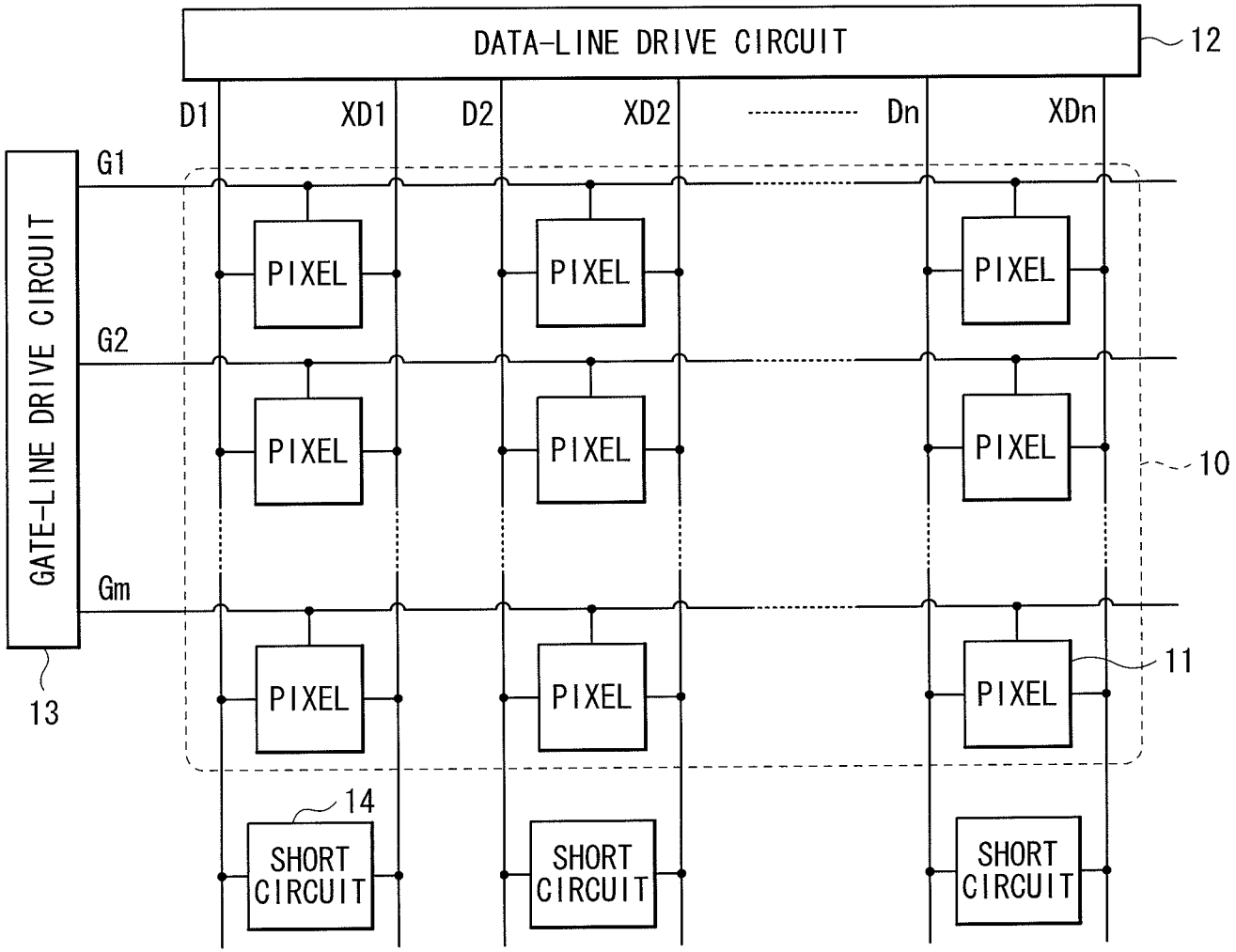
FIG. 5 is a block diagram illustrating a modification of the display device according to the first embodiment.

In the configuration in FIG. 1, the short circuit 14 is disposed closer to the data-line drive circuit 12; however, as illustrated in FIG. 5, the short circuit 14 may be disposed farther from the data-line drive circuit 12. In other words, the short circuit 14 and the data-line drive circuit 12 may be disposed with the display region 10 in between.

Second Embodiment

Next, a display device according to a second embodiment of the disclosure will be described below. It is to be noted that like components are denoted by like numerals as of the display device according to the first embodiment and will not be further described.

In the configuration illustrated in FIGS. 1 and 2, a pair of data lines are both connected to one pixel 11, and a positive-phase data signal and a negative-phase data signal are applied to the one pixel to perform writing of an image signal as a differential signal between the data signals. However, only one data line may be connected to one pixel. Then, writing of the image signal may be performed by applying one of the positive-phase data signal and the negative-phase data signal to the one pixel 11.

Figure 6:
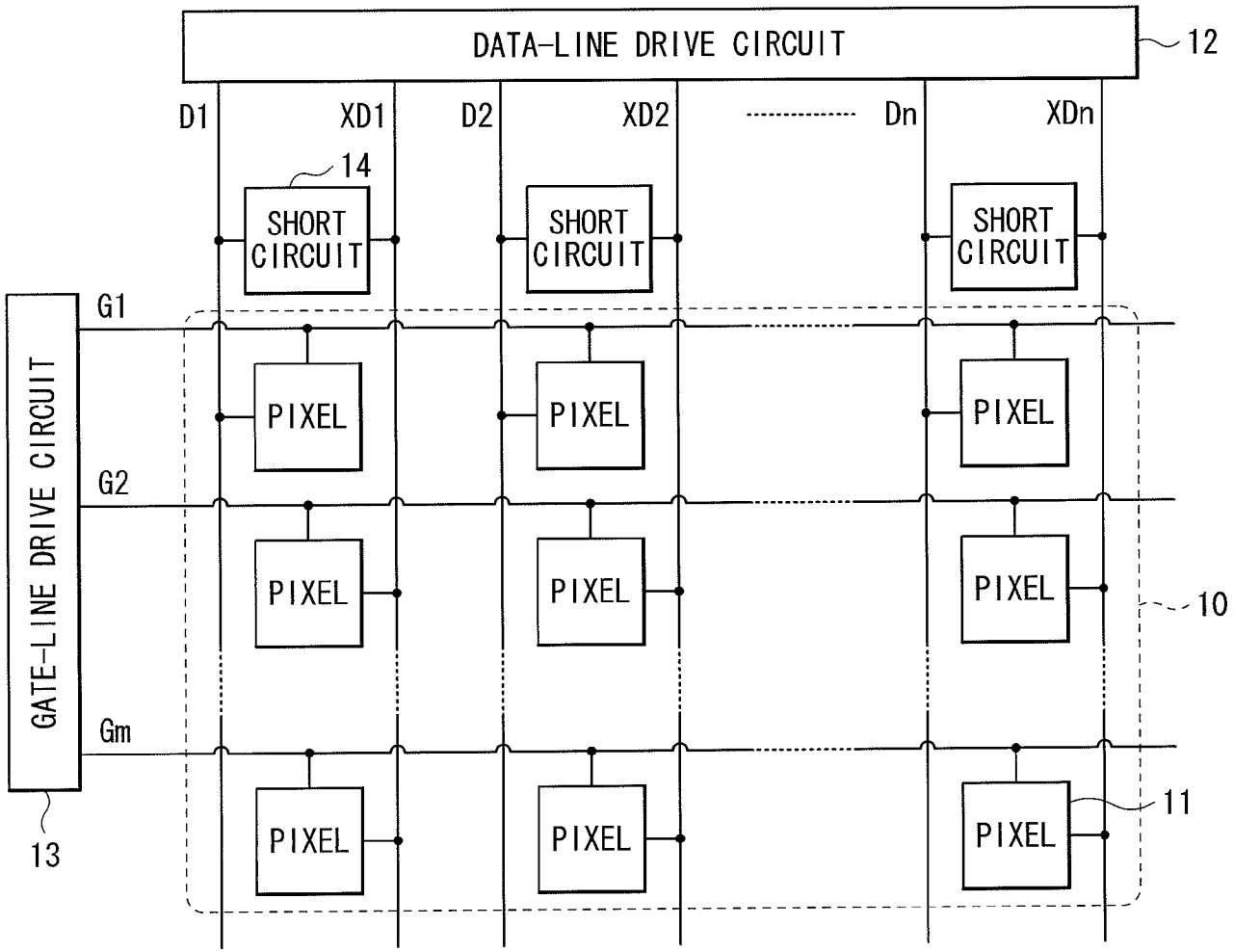
FIG. 6 is a block diagram illustrating a configuration example of a display device according to a second embodiment.
Figure 7:
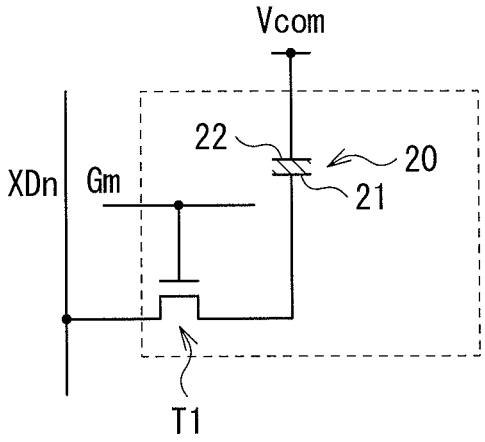
FIG. 7 is a circuit diagram illustrating a specific example of a drive circuit for each pixel in the display device according to the second embodiment.

A configuration example of such a circuit is illustrated in FIGS. 6 and 7. As illustrated in FIG. 6, respective pixels 11 in pixel columns along the vertical direction are alternately connected to one (for example, Dn) and the other (for example, XDn) of the pair of data lines (for example, Dn/XDn).

FIG. 7 illustrates a specific example of a drive circuit for each pixel 11. In FIG. 7, the pixel 11 connected to the data line XDn of the pair of data lines Dn/XDn and the gate line Gm is illustrated as a representative. The drive circuit includes a transistor T1 configured of a TFT, the pixel electrode 21, the counter electrode 22, and the liquid crystal capacitor 20 formed between the pixel electrode 21 and the counter electrode 22. The transistor T1 is connected to the data-line drive circuit 12 and the gate-line drive circuit 13 through the data line XDn and the gate line Gm.

In the display device illustrated in FIGS. 6 and 7, the positive-phase data signal and the negative-phase data signal as the image signals are alternately written to the respective pixels 11 arranged along the vertical direction. In this display device, as in the case of the display device according to the first embodiment, the pair of data lines are temporarily put in a short-circuit state by the short circuit 14 before writing of the image signal to the pixel 11 to set the potentials of the pair of data lines to an intermediate potential between a positive-phase potential and a negative-phase potential, and then the short-circuit state is released, and then writing of the image signal is performed. Therefore, potential variations in the data lines are suppressed to perform display with less image quality degradation caused by potential variations.

Modification of Second Embodiment

Figure 8:
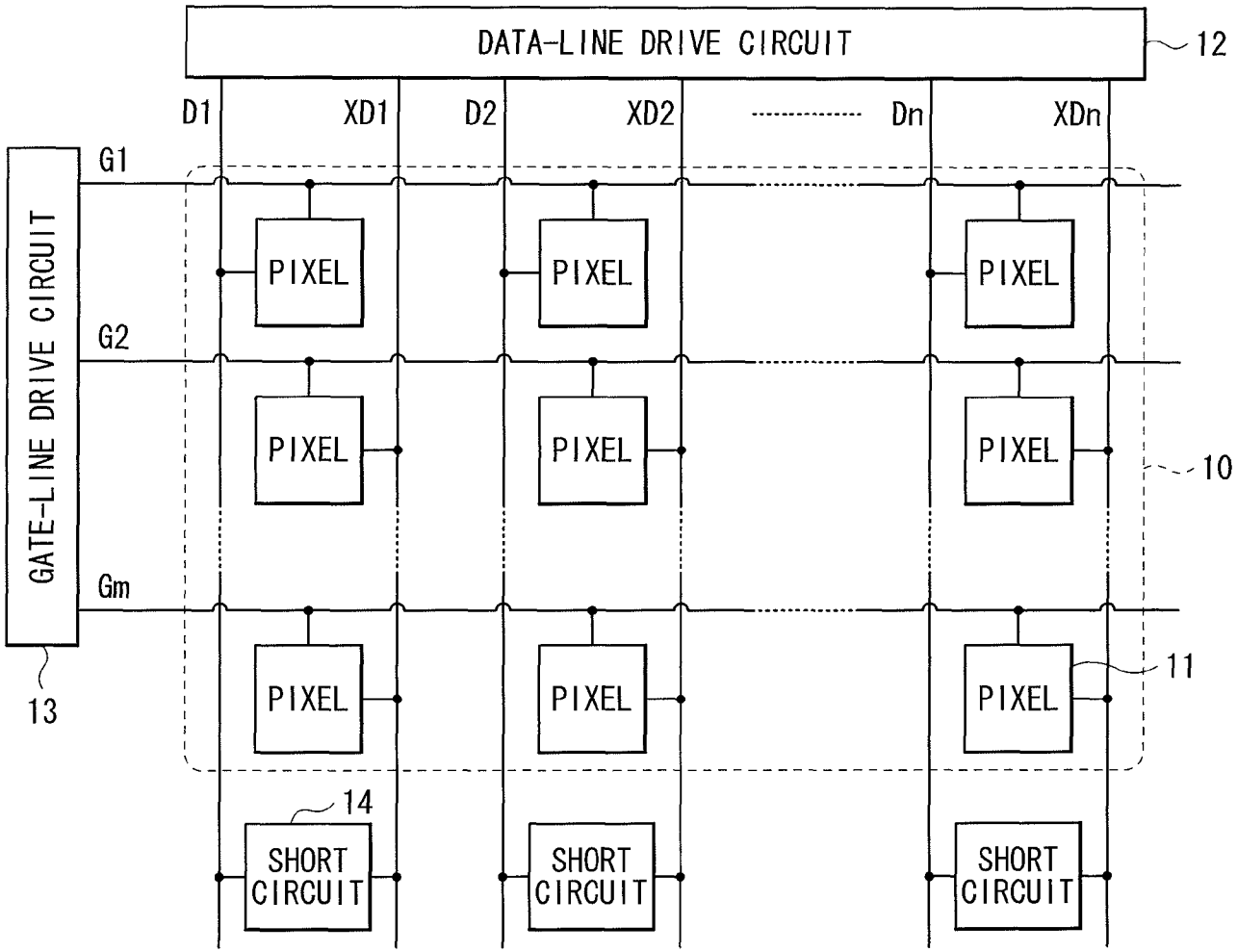
FIG. 8 is a block diagram illustrating a modification of the display device according to the second embodiment.

In the configuration in FIG. 6, the short circuit 14 is disposed closer to the data-line drive circuit 12. However, as illustrated in FIG. 8, the short circuit 14 may be disposed farther from the data-line drive circuit 12. In other words, the short circuit 14 and the data-line drive circuit 12 may be disposed with the display region 10 in between.

Other Embodiments

The technology of the present disclosure is not limited to the above-described embodiments, and may be variously modified. For example, the display devices according to the above-described respective embodiments are applicable to various electronic units having a display function. For example, the display devices according to the above-described respective embodiments are applicable to, for example, projection-type projectors, televisions, personal computers, and the like.

The present technology may have the following configurations.

(1) A display device including:

a plurality of data-line pairs arranged side by side along a first direction;

a plurality of gate lines arranged side by side along a second direction;

a display section including a plurality of pixels each disposed at an intersection of a data-line pair and a gate line and connected to one or both of the data-line pair;

a data-line drive circuit supplying a positive-phase data signal to one of the data-line pair and a negative-phase data signal to the other of the data-line pair, and allowing the data-line pair to stay in a high-impedance state before writing of an image signal to the pixels; and a short circuit putting the data-line pair in a short-circuit state while the data-line pair stays in the high-impedance state, and then releasing the short-circuit state, in which, following the release of the short-circuit state, the positive-phase data signal, the negative-phase data signal or both thereof are written into the pixel as the image signal.

(2) The display device according to (1), in which a pixel of the plurality of pixels is connected to both data lines of the corresponding data-line pair, and the image signal is written to the pixel as a differential signal between the positive-phase data signal and the negative-phase data signal.

(3) The display device according to (1), in which pixels arranged along the second direction are alternately connected to one line and the other line of the data-line pair, and the positive-phase data signal and the negative-phase data signal as the image signals are alternately written to the pixels arranged along the second direction.

(4) The display device according to any one of (1) to (3), in which the short circuit is disposed between the display section and the data-line drive circuit.

(5) The display device according to any one of (1) to (3), in which the short circuit and the data-line drive circuit are disposed with the display section in between.

(6) A method of driving a display device, the display device including a plurality of data-line pairs arranged side by side along a first direction, a plurality of gate lines arranged side by side along a second direction, a display section including a plurality of pixels each disposed at an intersection of a data-line pair and a gate line and connected to one or both of the data-line pair, a data-line drive circuit supplying a positive-phase data signal to one of the data-line pair and a negative-phase data signal to the other of the data-line pair, and allowing the data-line pair to stay in a high-impedance state before writing of an image signal to the pixels, and a short circuit putting the data-line pair in a short-circuit state while the data-line pair stays in the high-impedance state, and then releasing the short-circuit state, the method including, following the release of the short-circuit state, writing the positive-phase data signal, the negative-phase data signal or both thereof into the pixel as the image signal.

(7) An electronic unit including a display device, the display device including:

a plurality of data-line pairs arranged side by side along a first direction;

a plurality of gate lines arranged side by side along a second direction;

a display section including a plurality of pixels each disposed at an intersection of a data-line pair and a gate line and connected to one or both of the data-line pair;

a data-line drive circuit supplying a positive-phase data signal to one of the data-line pair and a negative-phase data signal to the other of the data-line pair, and allowing the data-line pair to stay in a high-impedance state before writing of an image signal to the pixels; and a short circuit putting the data-line pair in a short-circuit state while the data-line pair stays in the high-impedance state, and then releasing the short-circuit state, in which, following the release of the short-circuit state, the positive-phase data signal, the negative-phase data signal or both thereof are written into the pixel as the image signal.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A display device comprising:

a plurality of data-line pairs, each including a first data line and a second data line arranged in a first direction;

a plurality of gate lines arranged in a second direction;

a display section including a plurality of pixels each connected to at least one of the first data line and the second data line;

a data-line drive circuit configured to supply an image data signal to at least one of the plurality of pixels; and for each data-line pair, a short circuit disposed between the display section and the data-line drive circuit and connected to the first data line and the second data line such that only one short circuit is connected to each of the data-line pairs, wherein the short circuit is configured to set the first data line and the second data line in a short-circuit state, and wherein each pixel includes a pixel drive circuit that includes a first transfer gate TG1, a second transfer gate TG2, a third transfer gate TG3, a fourth transfer gate TG4, a first inverter INV1, and a second inverter INV2.

2. The display device according to claim 1, wherein the first data line and the second data line are in a differential configuration.

3. The display device according to claim 2, wherein the differential configuration is such that the first data line is in a positive phase while the second data line is in a negative phase.

4. The display device according to claim 1, wherein the short circuit is configured to set an intermediate potential between the first data line and the second data line by putting the first data line and second data line in the short-circuit state.

5. The display device according to claim 1, wherein the image signal is written to at least one of the plurality of pixels as a differential signal between a positive-phase data signal and a negative-phase data signal.

6. The display device according to claim 1, wherein the first direction intersects with the second direction.

7. The display device according to claim 1, wherein the pixel drive circuit includes a pixel electrode, a counter electrode that is a common electrode to the plurality of pixels, and a liquid crystal capacitor formed between the pixel electrode and the counter electrode.

8. The display device according to claim 7, wherein the first transfer gate TG1 is connected to a corresponding gate line and the first data line of the data-line pair, and the second transfer gate TG2 is connected to the gate line and the other data line of the data-line pair.

9. The display device according to claim 8, wherein the first inverter INV1 and the second inverter INV2 are disposed between the first transfer gate TG1 and the second transfer gate TG2.

10. The display device according to claim 9, wherein a first terminal of the third transfer gate TG3 is connected between the first transfer gate TG1, and the first inverter INV1 and second inverter INV2, and wherein a first terminal of the fourth transfer gate TG4 is connected between the second transfer gate TG2, and the first inverter INV1 and the second inverter INV2.

11. The display device according to claim 10, wherein the pixel electrode is connected to a second terminal of the third transfer gate TG3 and a second terminal of the fourth transfer gate TG4.

12. A method of driving a display device, the display device including a plurality of data-line pairs, each including a first data line and a second data line arranged in a first direction;

a plurality of gate lines arranged in a second direction;

a display section including a plurality of pixels each connected to at least one of the first data line and the second data line;

a data-line drive circuit configured to supply an image data signal to at least one of the plurality of pixels; and for each data-line pair, a short circuit disposed between the display section and the data-line drive circuit and connected to the first data line and the second data line such that only one short circuit is connected to each of the data-line pairs, the method comprising:

setting the first data line and the second data line in a short-circuit state by the short circuit;

releasing the short-circuit state; and following the release of the short-circuit state, writing a positive-phase data signal, a negative-phase data signal or both thereof into at least one of the plurality of pixels as the image data signal, and wherein each pixel includes a pixel drive circuit that includes a first transfer gate TG1, a second transfer gate TG2, a third transfer gate TG3, a fourth transfer gate TG4, a first inverter INV1, and a second inverter INV2.

13. An electronic apparatus including a display device, the display device comprising:

a plurality of data-line pairs, each including a first data line and a second data line arranged in a first direction;

a plurality of gate lines arranged in a second direction;

a display section including a plurality of pixels each connected to at least one of the first data line and the second data line;

a data-line drive circuit configured to supply an image data signal to at least one of the plurality of pixels; and for each data-line pair, a short circuit disposed between the display section and the data-line drive circuit and connected to the first data line and the second data line such that only one short circuit is connected to each of the data-line pairs, wherein the short circuit is configured to set the first data line and the second data line in a short-circuit state, and wherein each pixel includes a pixel drive circuit that includes a first transfer gate TG1, a second transfer gate TG2, a third transfer gate TG3, a fourth transfer gate TG4, a first inverter INV1, and a second inverter INV2.

14. The display device according to claim 13, wherein the first data line and the second data line are in a differential configuration.

15. The display device according to claim 14, wherein the differential configuration is such that the first data line is in a positive phase while the second data line is in a negative phase.

16. The display device according to claim 13, wherein the short circuit is configured to set an intermediate potential between the first data line and the second data line by putting the first data line and second data line in the short-circuit state.

* * * * *